US010092045B2

(12) United States Patent
Smith

(10) Patent No.: US 10,092,045 B2
(45) Date of Patent: Oct. 9, 2018

(54) MODULAR GARMENTS

(71) Applicant: Faye Sevilla Smith, Philadelphia, PA (US)

(72) Inventor: Faye Sevilla Smith, Philadelphia, PA (US)

( * ) Notice: Subject to any disclaimer, the term of this patent is extended or adjusted under 35 U.S.C. 154(b) by 14 days.

(21) Appl. No.: 14/672,363

(22) Filed: Mar. 30, 2015

(65) Prior Publication Data

US 2015/0272240 A1 Oct. 1, 2015

Related U.S. Application Data

(60) Provisional application No. 61/972,562, filed on Mar. 31, 2014.

(51) Int. Cl.
*A41D 15/00* (2006.01)

(52) U.S. Cl.
CPC ..... *A41D 15/00* (2013.01)

(58) Field of Classification Search
CPC .... A41D 15/00; A41D 15/002; A41D 15/005; A41D 15/007; A41D 15/02; A41D 15/04
USPC ..... 2/69, 49.5, 70, 71, 72, 79, 119, 213, 402
See application file for complete search history.

(56) References Cited

U.S. PATENT DOCUMENTS 459,106 A * 9/1891 Fifield ..... A41D 15/00 2/114
818,351 A * 4/1906 Clark ..... A41D 13/1236 2/114
974,981 A * 11/1910 Lee ..... A41D 13/1236 2/114
1,489,046 A * 4/1924 Thompson ..... A41B 9/08 2/114
1,505,986 A * 8/1924 Wellstatter ..... A41D 1/22 2/213
1,611,420 A * 12/1926 Cuddy ..... A41D 13/02 2/70
1,766,272 A * 6/1930 Vallier ..... A41B 9/06 2/114
2,077,772 A * 4/1937 Ring ..... A41H 3/06 33/13
2,206,505 A * 7/1940 Klein ..... A41F 9/02 2/237
2,211,100 A * 8/1940 Cohen ..... A41D 1/22 2/70
2,285,692 A * 6/1942 Wickman ..... A41D 13/02 2/227
2,297,159 A * 9/1942 Mohler ..... A41D 1/20 2/76
2,498,332 A * 2/1950 Brick ..... A41D 15/00 2/74

(Continued)

*Primary Examiner* — Shaun R Hurley
*Assistant Examiner* — Bao-Thieu L Nguyen
(74) *Attorney, Agent, or Firm* — Fox Rothschild LLP

(57) ABSTRACT

A modular garment including first and second panels. The first and second panels are aligned with one another such that the first panel first side edge aligns with the second panel second side edge and the first panel second side edge aligns with the second panel side edge and wherein the at least one first panel male connector releasably engages the at least one second panel female connector and the at least one first panel female connector releasably engages the at least one second panel male connector to releasably interconnect the first and second panels to define the garment.

12 Claims, 8 Drawing Sheets

(56) References Cited

U.S. PATENT DOCUMENTS 2,582,772 A * 1/1952 Egbert ..... A41D 3/00 2/103
2,670,470 A * 3/1954 Manheim ..... A41D 15/04 2/69.5
2,697,224 A * 12/1954 Aidenland ..... A41B 9/08 2/218
2,722,686 A * 11/1955 Hoskings ..... A41D 15/00 2/74
2,777,130 A * 1/1957 Keller ..... A41D 15/00 2/75
2,779,944 A * 2/1957 Flach ..... A41D 15/00 2/85
2,807,804 A * 10/1957 Miller ..... A41D 15/00 2/126
2,808,590 A * 10/1957 Siegel ..... A41B 13/00 2/111
3,064,265 A * 11/1962 Bridgewaters ..... A41D 15/002 2/105
3,110,903 A * 11/1963 Burchard ..... A41D 1/08 2/211
3,116,491 A * 1/1964 Previdi ..... A41D 1/20 2/102
3,276,036 A * 10/1966 Cater ..... A41D 13/1236 2/114
3,431,562 A * 3/1969 Souders ..... A41D 1/20 2/221
3,997,982 A * 12/1976 Holland ..... G09B 25/00 2/102
4,156,969 A * 6/1979 Werber ..... A41H 3/015 33/14
4,158,892 A * 6/1979 Gonzales ..... A41D 10/00 2/69.5
4,364,124 A * 12/1982 Barna ..... A41H 37/003 2/234
4,606,078 A * 8/1986 Tkacsik ..... A41D 1/20 2/102
4,631,765 A * 12/1986 Casey ..... A47G 9/0207 428/33
4,638,509 A * 1/1987 Charron ..... A41D 1/08 2/2.15
4,683,595 A * 8/1987 Cash ..... A41D 15/00 2/105
4,759,083 A * 7/1988 Belcher ..... A41D 13/1236 2/114
4,803,740 A * 2/1989 Dawson ..... A41D 1/20 2/215
4,995,115 A * 2/1991 Ellis ..... A41D 13/129 2/114
5,062,159 A * 11/1991 Jakub ..... A41D 13/1236 2/105
5,315,716 A * 5/1994 Baum ..... A41D 1/06 2/114
5,592,691 A * 1/1997 Ronald ..... A41D 15/00 2/243.1
5,628,064 A * 5/1997 Chung ..... A41D 15/00 2/119
D381,488 S * 7/1997 Small ..... A41D 15/00 D2/718
5,894,600 A * 4/1999 Chenefront ..... A41D 15/00 2/105
6,014,772 A * 1/2000 Connelly ..... A41D 3/005 2/102
6,282,717 B1 * 9/2001 Ng ..... A41D 1/04 2/115
6,282,718 B1 * 9/2001 Drakford ..... A41D 13/0015 2/115
6,298,485 B1 * 10/2001 Heller ..... A41D 3/005 2/126
6,611,964 B2 * 9/2003 Lipsett ..... A41D 1/06 2/227
6,694,521 B1 * 2/2004 Hopkins ..... A41B 13/08 2/114
7,131,147 B2 * 11/2006 Villegas ..... A41D 1/14 2/211
7,231,671 B2 * 6/2007 Allen ..... A41D 1/06 2/227
7,395,556 B2 * 7/2008 Eraca ..... A41D 13/1236 2/104
8,075,366 B1 * 12/2011 Jaksic ..... A41C 3/08 2/105
8,127,370 B2 * 3/2012 Nunn ..... A41D 1/08 2/227
8,161,573 B1 * 4/2012 Burns-Cox ..... A41D 13/1245 2/227
8,245,322 B1 * 8/2012 Bouza ..... A41D 13/0012 2/102
8,272,072 B1 * 9/2012 Fowler ..... A41D 15/00 2/263
8,549,665 B2 * 10/2013 Putfark ..... A41D 13/1236 2/114
8,918,915 B2 * 12/2014 Caulfield ..... A41D 7/005 2/67
9,015,864 B2 * 4/2015 Evans ..... A41F 5/00 2/227
9,060,552 B2 * 6/2015 Lekkas ..... A41D 1/22
2003/0046747 A1 * 3/2003 Berns ..... A41D 13/0153 2/69
2004/0030311 A1 * 2/2004 Suzuki ..... A61F 13/15211 604/367
2004/0216218 A1 * 11/2004 McCarthy ..... A41D 1/08 2/228
2006/0048262 A1 * 3/2006 Sencion ..... A41D 15/005 2/69
2009/0320175 A1 * 12/2009 Shih ..... A41D 15/00 2/69
2012/0204307 A1 * 8/2012 De Mattei ..... A41D 1/002 2/69
2013/0152266 A1 * 6/2013 Johnson ..... A41D 1/04 2/69
2013/0318677 A1 * 12/2013 Liu ..... A41D 27/10 2/69
2015/0040281 A1 * 2/2015 Gbadamosi ..... A41D 27/201 2/69
2015/0040286 A1 * 2/2015 Schultz ..... A41D 1/00 2/88
2015/0068469 A1 * 3/2015 Potts ..... A01K 23/00 119/850
2015/0153140 A1 * 6/2015 Crye ..... F41H 1/02 2/102
2015/0201686 A1 * 7/2015 Gauthier ..... A41D 1/18 2/69
2015/0237932 A1 * 8/2015 Carryl ..... A41D 13/1254 2/69

* cited by examiner

MODULAR GARMENTS

This application claims the benefit of U.S. Provisional Patent Application No. 61/972,562, which was filed on Mar. 31, 2014, the contents of which are incorporated herein.

FIELD OF THE INVENTION

This invention relates to modular garments. More particularly, the invention relates to modular top and bottom garments which include modular front and rear panels.

BACKGROUND OF THE INVENTION

Existing apparel construction through current methods of sewing limit the use, size, and general aesthetics of garments. With current modifiable garments and prior art, fronts and backs are not separateable thereby limiting the changeability of style or size. Prior to my invention, apparel construction has either had permanent seams or is separateable only from top to bottom, or body to sleeves. These previous systems of apparel construction severely limits the changes the wearer can make on the garment. It also makes the wearer commit to the current size of the garment.

SUMMARY OF THE INVENTION

In at least one embodiment, the invention allows the wearer to change styles, add sizes to the current garment, and interchange other modular pieces to transform a garment's use and style. The modular garment system is fabricated as modular reattachable panels that separate not only portions of the garment from top to bottom or body to sleeves, but also separates front and back panels and allows garment parts that can be interchanged or added to alter garment.

In at least one embodiment, the invention provides a modular garment including first and second panels. The first panel has a body between top and bottom edges and opposed first and second side edges wherein the first side edge includes at least one male connector and the second side edge includes at least one female connector. The second panel has a body between top and bottom edges and opposed first and second side edges wherein the first side edge includes at least one male connector and the second side edge includes at least one female connector. The first and second panels are aligned with one another such that the first panel first side edge aligns with the second panel second side edge and the first panel second side edge aligns with the second panel side edge and wherein the at least one first panel male connector releasably engages the at least one second panel female connector and the at least one first panel female connector releasably engages the at least one second panel male connector to releasably interconnect the first and second panels to define the garment.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
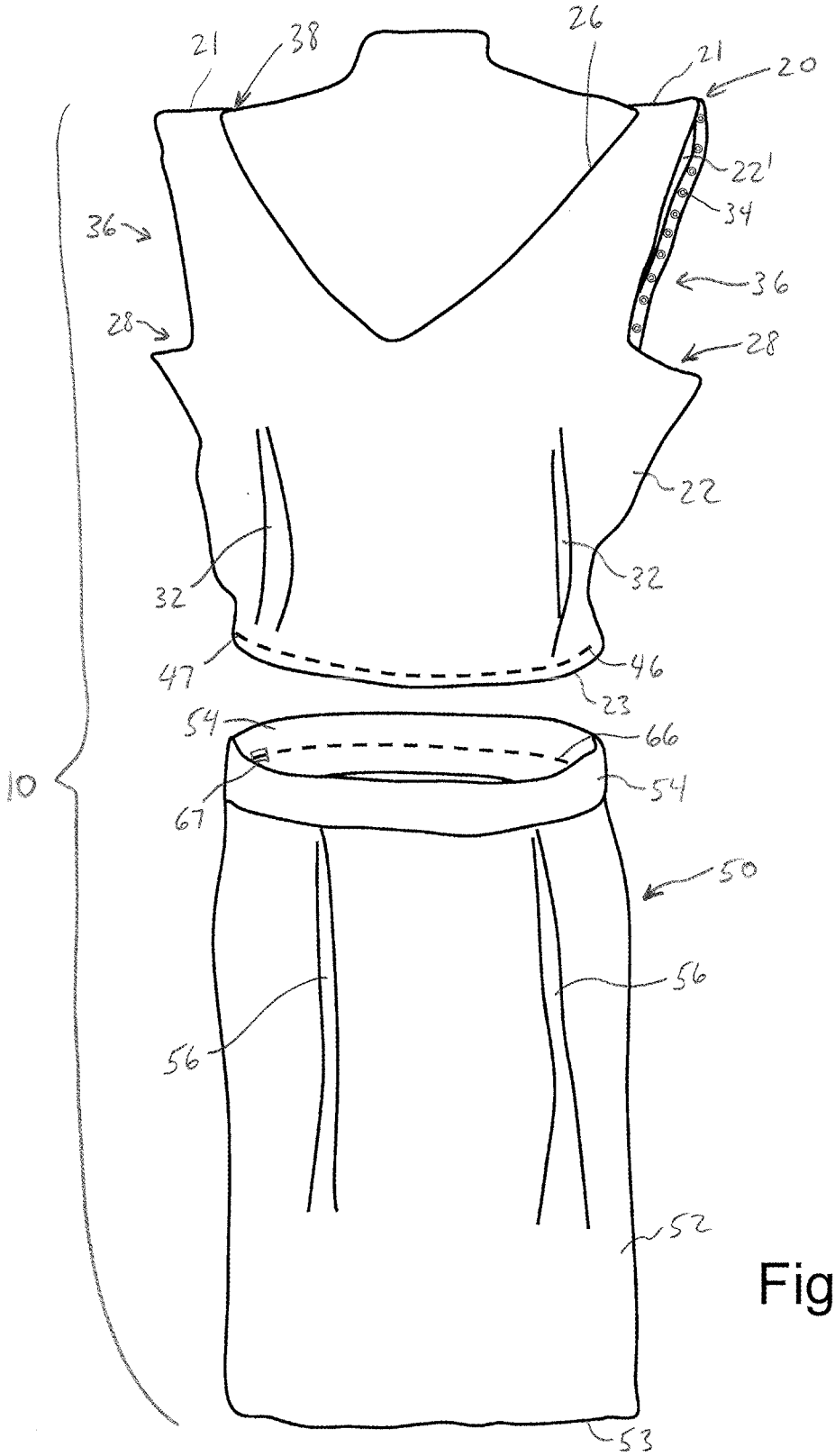
FIG. 1 is a perspective view of an exemplary garment in accordance with an embodiment of the invention shown partially exploded.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
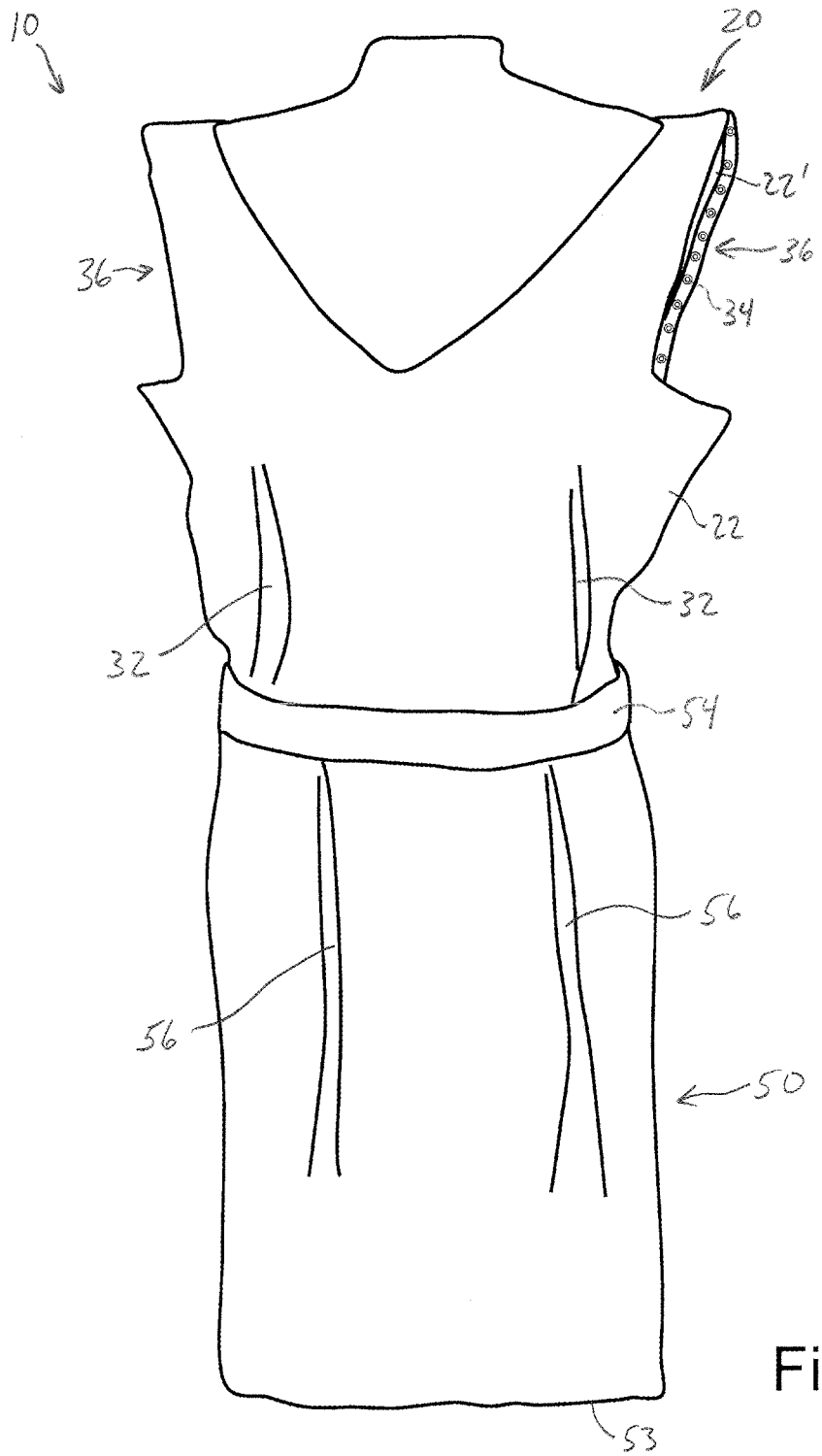
FIG. 2 is a perspective view of the garment of FIG. 1 fully assembled.

Referring to FIGS. 1 and 2, a first modular garment 10 in accordance with an embodiment of the invention will be described. The first modular garment 10 is in the form of a dress including a top garment 20 releasably attached to a bottom garment 50. The top garment 20 defines a shoulder area 38, arm holes 36 and a waistline 37. The bottom garment 50 defines a waistband 54 and extends to a hemline 53. It is noted that the bottom garment 50 may be worn as a separate skirt without interconnection to a top garment. As explained below, the bottom garment 50 may include internal zippers inset within the waistband to allow the skirt to be worn by itself without the top garment.

To interconnect the top and bottom garments 20, 50 to form the dress, an external zipper 46 extends along the waistline 37 and an internal zipper 66 extends along the waistband 54. As explained in more detail hereinafter, the external zipper 46 and internal zipper 66 may be defined by separate front and rear zippers. In the illustrated embodiment, the external zipper 46 is a male zipper and the internal zipper 66 is a female zipper. That is, the external zipper 46 includes an extending end 47 configured to be received in a female zipper slider 67 of the internal zipper 66. The external and internal zippers 46, 66 interconnect and disconnect in a known manner to facilitate attachment and detachment of the top garment 20 and the bottom garment 50. As illustrated, a series of snaps 34, preferably female snaps, extend along the internal perimeter of the arm holes 36 for attachment of sleeves if desired.

Figure 3:
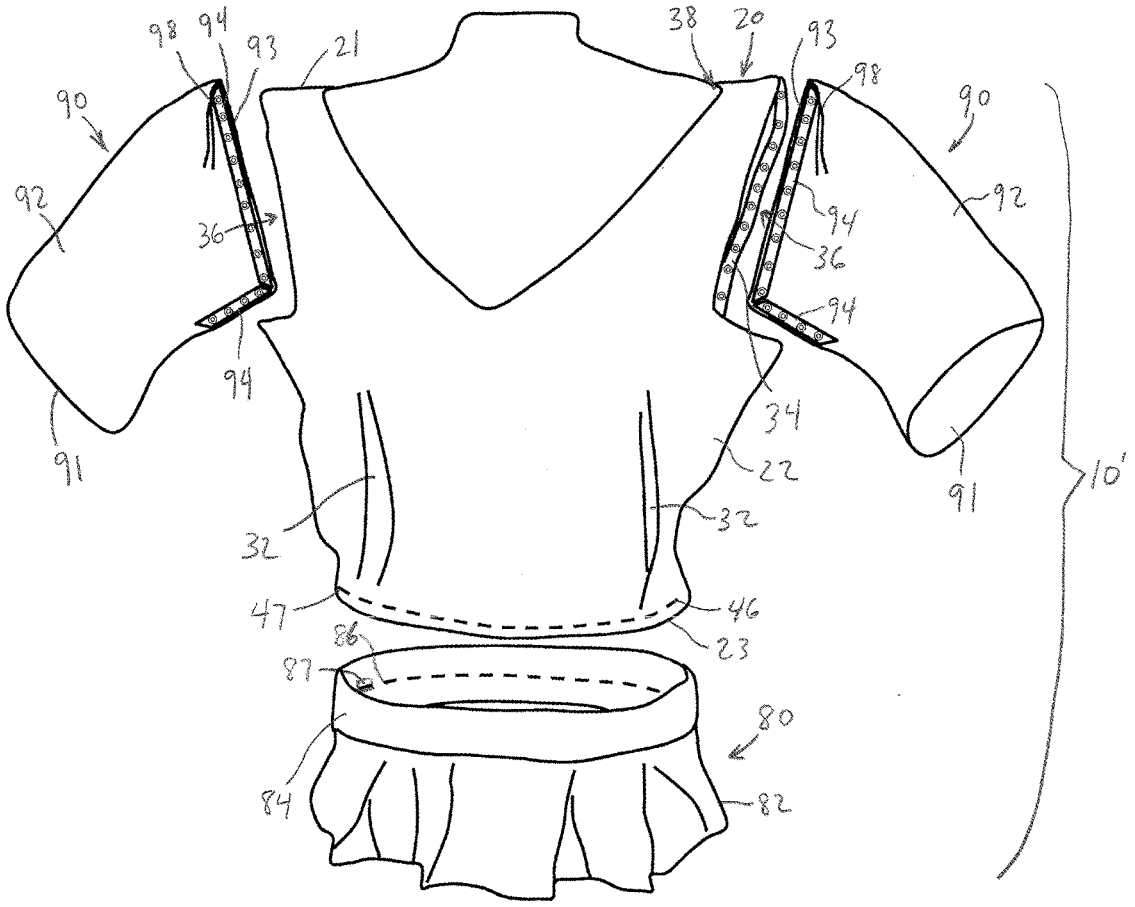
FIG. 3 is a perspective view of another exemplary garment in accordance with an embodiment of the invention shown partially exploded.
Figure 4:
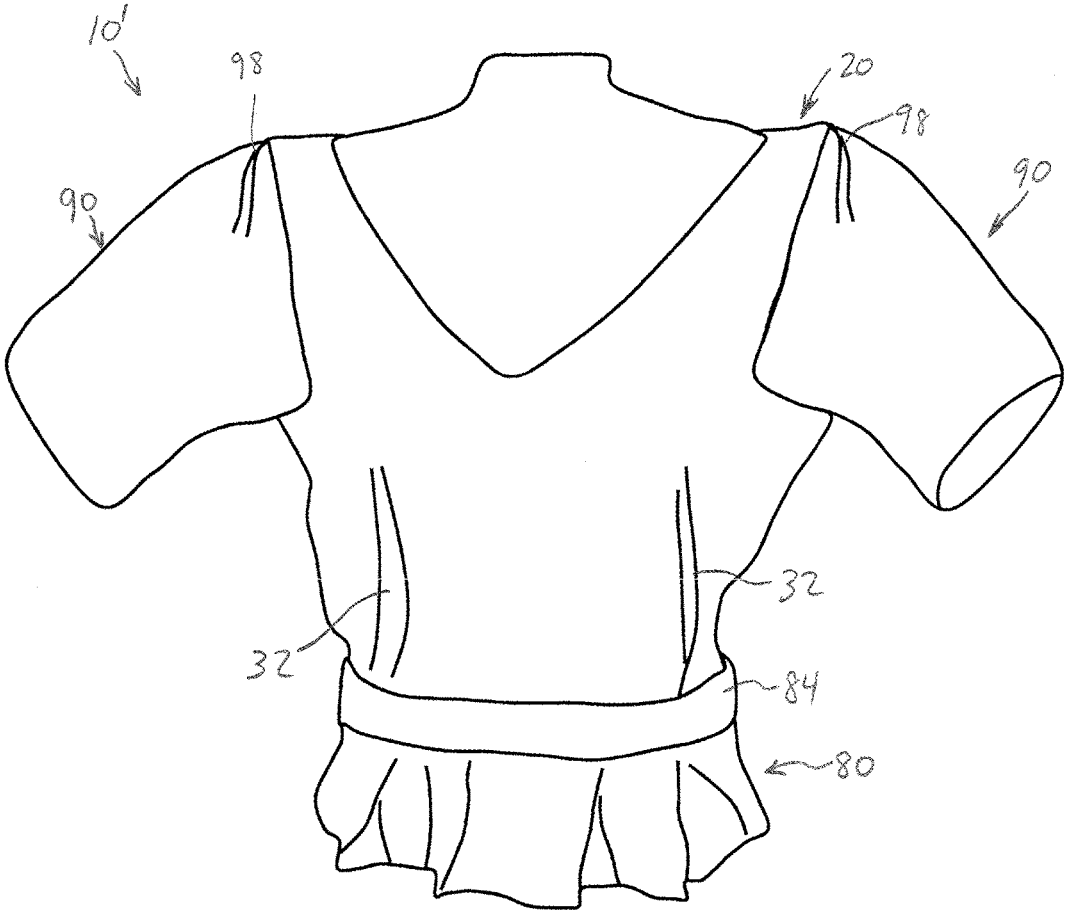
FIG. 4 is a perspective view of the garment of FIG. 3 fully assembled.

Referring to FIGS. 3 and 4, a second modular garment 10' in accordance with an embodiment of the invention will be described. The second modular garment 10' is in the form of a shirt. The shirt 10' may utilize the same top garment 20 that was used in the previous embodiment to form the dress. A peplum module 80 attaches to the waistline 37 of the top garment 20 such that the garment 10' will have sufficient length to be worn as a shirt. The peplum module 80 includes a body 82 of a desired length and a waistband 84. An internal female zipper 86 extends along the waistband 84 and includes a female zipper slider 87 for engagement with the top external zipper 46. In the illustrated embodiment, a pair of sleeves 90 are configured for attachment to the arm holes 36. Each sleeve 90 includes a tubular body 92 extending between a free end 91 and an attachment end 93. A series of snaps 94, preferably male snaps, extend along the external perimeter of the attachment end 93 for attachment of sleeves to the top garment 20. The snaps 94 are preferably provided on two linear pieces of tape to match the armseye 28 as described hereinafter. The shoulder area of the each sleeve 90 may be formed with pleats 98 to hide the bulk that the snaps make in the garment, allowing the garment to seem whole. While short sleeves are illustrated, it is desired that sleeves of any desired length may be utilized. The modular nature of the garment allows sleeves of different lengths to be used with the same top garment 20, for example, depending on the season.

The garments 10 and 10' are provided as two exemplary garments that may be formed with the modular components. It is recognized that a wide variety of garments beyond the illustrated garments may be formed utilizing various components. To further increase the variety, the top and bottom garments 20, 50 may each be modular between the front surface and the rear surface. Similarly, the plenum modules 80 and sleeves 90 may similarly be made to be modular front to back in a manner similar to that described below with respect to the top and bottom garments 20, 50.

Figure 5:
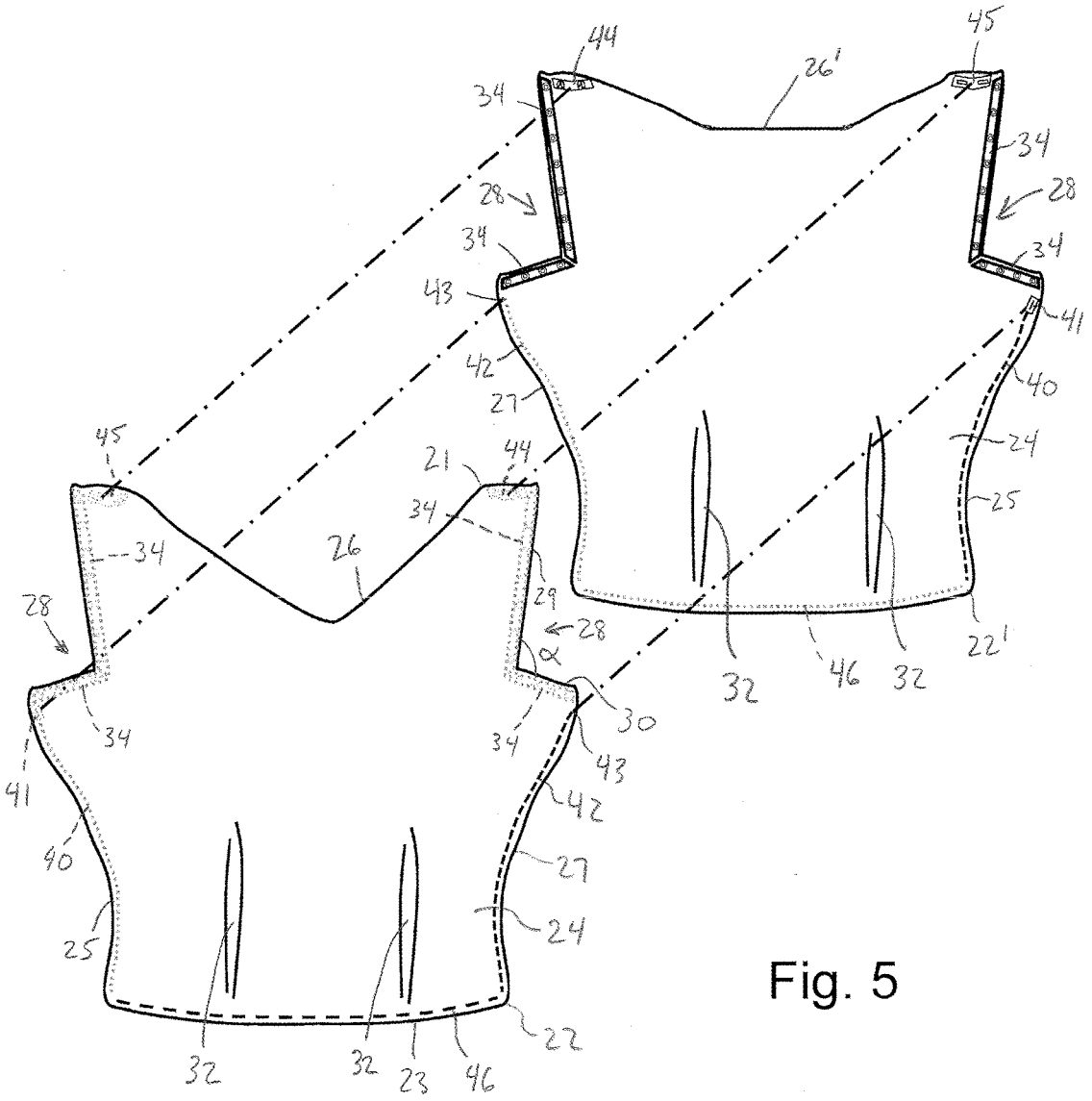
FIG. 5 is an exploded perspective view of an exemplary top garment in accordance with an embodiment of the invention.

Referring to FIG. 5, a modular top garment 20 will be described. The modular top garment 20 includes a front panel 22 and a rear panel 22'. It is noted that the panel 22 includes a v-neckline 26 while the panel 22' includes a standard neckline 26'. In other aspects, the panels 22, 22' are substantially the same. While the illustrated embodiment utilizes different front and rear panels 22, 22', it is recognized that either panel may be utilized as the front or the rear and the front and rear panels may be different or the same. Each panel 22, 22' extends from a top edge 21 to a bottom edge 23 and between opposed side edges 25, 27. When the two panels 22, 22' are interconnected, the top edges 21 will define the shoulder area 38 of the top garment 20 and the bottom edges 23 will define the waistline 37 of the top garment 20.

To interconnect the two panels 22, 22', one side edge 25 includes an internal female zipper 40 with a female zipper slider 41 and the other side edge 27 includes an external male zipper 42 with a male extension 43. In the present embodiment, the top edge 21 adjacent the side edge 25 includes female eyes 45 while the top edge 21 adjacent the side edge 27 includes male hooks 44. As illustrated in FIG. 5, when the internal surfaces of the two panels 22, 22' face each other, the female zippers 40 on side edges 25 align with the male zipper 42 on the side edge 27 of the opposed panel. Similarly, the female eyes 45 adjacent the side edges 25 align with the male hooks 44 adjacent the side edge 27 of the opposed panel. This configuration, i.e. male connectors on one side edge of the panel and female connectors on the opposite side edge of the panel, allows the panels to be utilized as either front or rear panels. The zippers and snaps may be color coded to allow ease in combining the modules.

To facilitate proper fit and appearance of the top garment 20, the panels 22, 22' may include additional features which facilitate use as a front or rear panel. One such feature includes the pleats 32 extending generally parallel to the side edges 25, 27 adjacent the bottom edge 23. The pleats 32 allow the panel 22, 22' to be worn in front and accommodate the bust or to lay flat when worn on the back.

As another feature, the angle of the armseye 28 is specifically angled as to allow the piece to be worn in front or in back. That is, the armseye 28 includes two generally linear portions 29, 30 which are at an obtuse angle $\alpha$ relative to one another. Similarly, the snaps 34 are preferably provided on two pieces of tape with each tape following the respective linear portion 29, 30. Such a configuration avoids a rounded armseye, as the other garments, which would gape open or pull when worn in an opposing manner from intended, making it unwearable.

As previously explained, snaps 34 are provided along the armseye 28 for connection of sleeves if desired. The snaps 34 are set into the sleeve in the armseye 28 to hide the snaps 28 as to not appear as an un-whole garment. The snaps 34 may be fused to tape which is then sewn onto garment. The use of snap tape alleviates stress from the garment when the sleeves are separated. The snaps 34 on the armseye 28 are preferably female snaps while the snaps 94 on the sleeves 90 are preferably male snaps. With this configuration, the male snaps point away from the body. This allows the garment to be worn comfortably even without sleeves attached.

Figure 6:
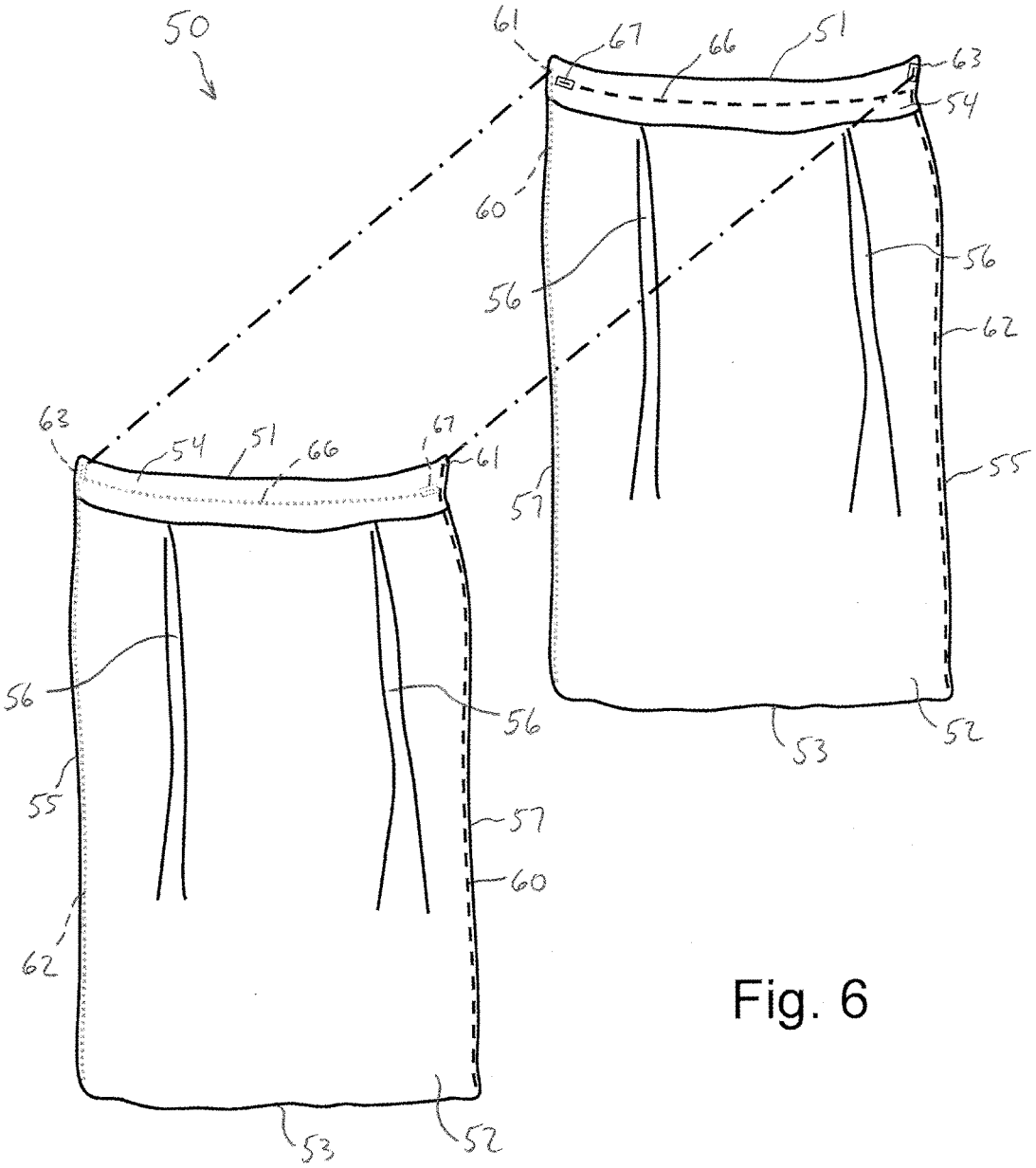
FIG. 6 is an exploded perspective view of an exemplary bottom garment in accordance with an embodiment of the invention.

Referring to FIG. 6, a modular bottom garment 50 will be described. The modular bottom garment 50 includes a front panel 52 and a rear panel 52. While the illustrated embodiment utilizes identical front and rear panels 52, it is recognized that either panel may be utilized as the front or the rear and the front and rear panels may be different or the same. Each panel 52 extends from a top edge 51 to a bottom edge 53 and between opposed side edges 55, 57. When the two panels 52 are interconnected, the top edges 51 will define the waistband 54 of the bottom garment 50 and the bottom edges 53 will define the hemline of the bottom garment 50.

To interconnect the two panels 52, one side edge 55 includes an internal female zipper 62 with a female zipper slider 63 and the other side edge 57 includes an external male zipper 60 with a male extension 61. As illustrated in FIG. 6, when the internal surfaces of the two panels 52 face each other, the female zippers 62 on side edges 25 align with the male zipper 60 on the side edge 57 of the opposed panel. This configuration, i.e. male connectors on one side edge of the panel and female connectors on the opposite side edge of the panel, allows the panels to be utilized as either front or rear panels. In the illustrated embodiment, the zippers 66 at the waistline 54 are sewn to begin and end away from the sides 55, 57 of the garment 50 to minimize the bulk created when four corners of a garment combined with zippers meet. The zippers may be color coded to allow ease in combining the modules.

To facilitate proper fit and appearance of the top garment 20, the panels 52 may include additional features which facilitate use as a front or rear panel. One such feature includes pleats 56 extending generally parallel to the side edges 55, 57 adjacent the top edge 51. The pleats 56 allow the panel 52 to be worn in the front while accommodating the rear end when worn in the back. Without this modification, skirts would either balloon in the front or pull/tug and be unwearable in the back.

Figure 7:
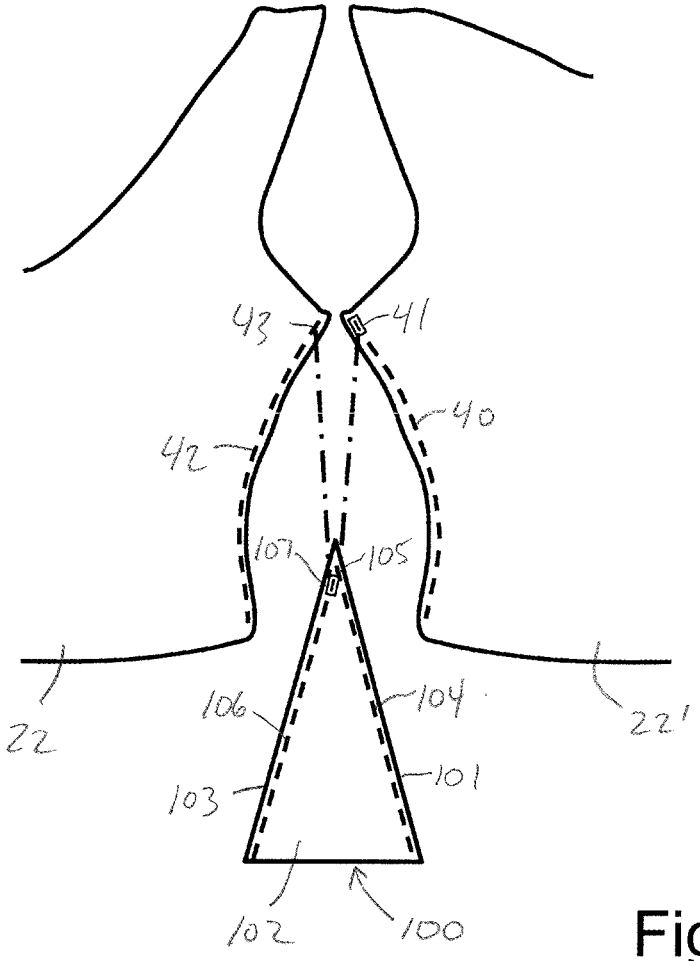
FIG. 7 is a partial plan view of another exemplary garment including an expander member.
Figure 8:
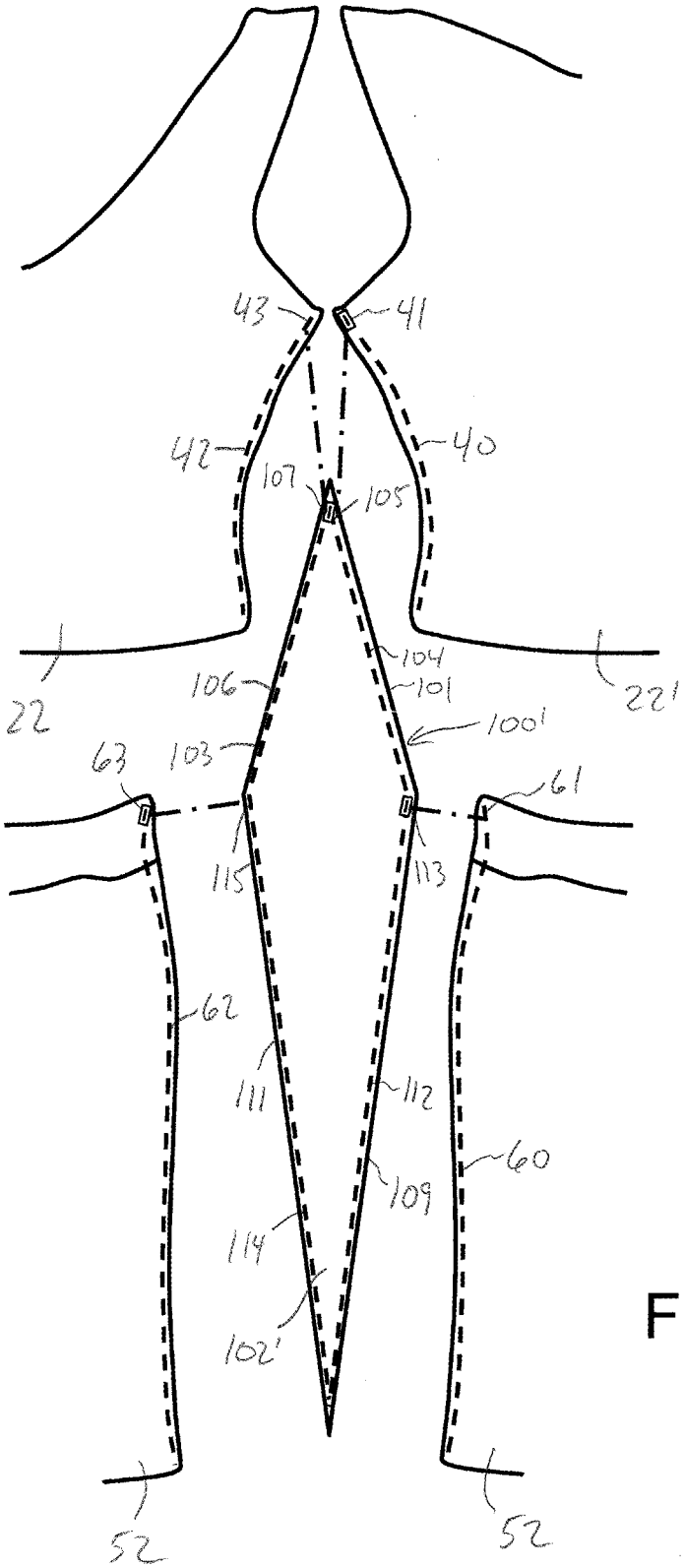
FIG. 8 is a partial plan view of another exemplary garment including an expander member.

Referring to FIGS. 7 and 8, expander panels 100, 100' usable with the panels 22, 22' and 52. In the embodiment illustrated in FIG. 7, the expander panel 100 is configured to be positioned between two top garment panels 22, 22'. The illustrated panel 100 has a triangular body 102 with opposed side edges 101 and 103. The panel 100 may have a shape other than triangular. A male zipper 104 with a male extension 105 extends along the side edge 101 and is configured to interconnect with the female zipper 40 of the panel 22'. A female zipper 106 with a female zipper slider 107 extends along the side edge 103 and is configured to interconnect with the male zipper 42 of the panel 22. The expander panel 100 allows the waistline 37 of the top garment 20 to be expanded, for example, to be utilized as a maternity shirt.

In the embodiment illustrated in FIG. 8, the expander panel 100' is configured to be positioned between two top garment panels 22, 22' and two bottom panels 52. The illustrated panel 100' has a diamond shaped body 102 with opposed upper side edges 101 and 103 and opposed lower side edges 109 and 111. The panel 100' may have a shape other than diamond shape. A male zipper 104 with a male extension 105 extends along the side edge 101 and is configured to interconnect with the female zipper 40 of the panel 22'. A female zipper 106 with a female zipper slider 107 extends along the side edge 103 and is configured to interconnect with the male zipper 42 of the panel 22. A male zipper 114 with a male extension 115 extends along the side edge 111 and is configured to interconnect with the female zipper 62 of the panel 52. A female zipper 112 with a female zipper slider 113 extends along the side edge 109 and is configured to interconnect with the male zipper 60 of the panel 52. The expander panel 100' allows the waistline 37 of the top garment 20 and the waistband 54 of the bottom garment 50 to be expanded, for example, to be utilized as a maternity dress. Expander panels may be configured to be positioned between top panels or bottom panels or both top and bottom panels.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A modular garment system comprising:

a top garment comprising:

a first top panel having a body between top and bottom edges and opposed first and second side edges, wherein the first side edge of the first top panel includes at least one male connector affixed proximate thereto, the second side edge of the first top panel includes at least one female connector affixed proximate thereto, and the bottom edge of the first top panel includes at least one male connector affixed proximate thereto; and a second top panel having a body between top and bottom edges and opposed first and second side edges, wherein the first side edge of the second top panel includes at least one female connector affixed proximate thereto, the second side edge of the second top panel includes at least one male connector affixed proximate thereto, and the bottom edge of the second top panel includes at least one male connector affixed proximate thereto;

a bottom garment comprising: a first bottom panel having a body between top and bottom edges and opposed first and second side edges, wherein the first side edge of the first bottom panel includes at least one male connector affixed proximate thereto, the second side edge of the first bottom panel includes at least one female connector affixed proximate thereto, and the top edge of the first bottom panel includes at least one female connector affixed proximate thereto; and a second bottom panel having a body between top and bottom edges and opposed first and second side edges, wherein the first side edge of the second bottom panel includes at least one female connector affixed proximate thereto, the second side edge of the second bottom panel includes at least one male connector affixed proximate thereto, and the top edge of the second bottom panel includes at least one female connector affixed proximate thereto; and at least one expander panel comprising:

a first upper side edge having at least one female connector affixed proximate thereto;

a second upper side edge having at least one male connector affixed proximate thereto, the second upper side edge opposing the first upper side edge;

a first lower side edge having at least one male connector affixed proximate thereto; and a second lower side edge having at least one female connector affixed proximate thereto, the second lower side edge opposing the first lower side edge;

wherein the at least one expander panel is configured to be selectively attachable to the first top panel, the second top panel, the first bottom panel, and the second bottom panel, and further wherein the top garment is configured to be selectively attachable to the bottom garment by the at least one male connector affixed proximate to the respective bottom edges of the first top panel and the second top panel and the at least one female connector affixed proximate to the respective top edges of the first bottom panel and the second bottom panel.

2. The modular garment system of claim 1, wherein the at least one expander panel is configured to be selectively attachable to the first top panel along the first upper side edge, the second top panel along the second upper side edge, the first bottom panel along the first lower side edge, and the second bottom panel along the lower side edge.

3. The modular garment system of claim 1, wherein the at least one male connector affixed proximate to the first side edge of the first top panel is selectively attachable to the at least one female connector affixed proximate to the first upper side edge of the at least one expander panel, and further wherein the at least one female connector affixed proximate to the first side edge of the second top panel is selectively attachable to the at least one male connector affixed proximate to the second upper side edge of the at least one expander panel.

4. The modular garment system of claim 3, wherein the at least one male connector affixed proximate to the first side edge of the first top panel comprises a male zipper, the at least one female connector affixed proximate to the first upper side edge of the at least one expander panel comprises a female zipper, the at least one female connector affixed proximate to the first side edge of the second top panel comprises a female zipper, and the at least one male connector affixed proximate to the second upper side edge of the at least one expander panel comprises a male zipper.

5. The modular garment system of claim 1, wherein the at least one female connector affixed proximate to the first side edge of the first bottom panel is selectively attachable to the at least one male connector affixed proximate to the first lower side edge of the at least one expander panel, and further wherein the at least one male connector affixed proximate to the first side edge of the second bottom panel is selectively attachable to the at least one female connector affixed proximate to the second lower side edge of the at least one expander panel.

6. The modular garment system of claim 5, wherein the at least one female connector affixed proximate to the first side edge of the first bottom panel comprises a female zipper, the at least one male connector affixed proximate to the first lower side edge of the at least one expander panel comprises a male zipper, the at least one male connector affixed proximate to the first side edge of the second bottom panel comprises a male zipper, and the at least one female connector affixed proximate to the second lower side edge of the at least one expander panel comprises a female zipper.

7. The modular garment system of claim 1, wherein the at least one expander panel is a diamond-shaped panel.

8. The modular garment system of claim 1, wherein the first and second top panels each include an armseye defined along each side edge proximate to the respective top edges such that upon interconnection of the first and second top panels, the armseyes define arm holes on each side of the garment, further wherein each armseye includes two generally linear portions with an obtuse angle extending between the two generally linear portions.

9. The modular garment system of claim 8, further comprising at least one female connector affixed to an internal surface of each of the first and second top panels along each armseye.

10. A modular garment system comprising:

a top garment comprising:

a first top panel having a body between top and bottom edges and opposed first and second side edges, wherein the first side edge of the first top panel includes at least one male connector affixed proximate thereto, the second side edge of the first top panel includes at least one female connector affixed proximate thereto, and the bottom edge of the first top panel includes at least one male connector affixed proximate thereto; and a second top panel having a body between top and bottom edges and opposed first and second side edges, wherein the first side edge of the second top panel includes at least one female connector affixed proximate thereto, the second side edge of the second top panel includes at least one male connector affixed proximate thereto, and the bottom edge of the second top panel includes at least one male connector affixed proximate thereto;

a bottom garment comprising:

a first bottom panel having a body between top and bottom edges and opposed first and second side edges, wherein the first side edge of the first bottom panel includes at least one male connector affixed proximate thereto, the second side edge of the first bottom panel includes at least one female connector affixed proximate thereto, and the top edge of the first bottom panel includes at least one female connector affixed proximate thereto; and a second bottom panel having a body between top and bottom edges and opposed first and second side edges, wherein the first side edge of the second bottom panel includes at least one female connector affixed proximate thereto, the second side edge of the second bottom panel includes at least one male connector affixed proximate thereto, and the top edge of the second bottom panel includes at least one female connector affixed proximate thereto; and an expander panel configured to be selectively attachable to the first top panel, the second top panel, the first bottom panel, and the second bottom panel, wherein the top garment is configured to be selectively attachable to the bottom garment by the at least one male connector affixed proximate to the respective bottom edges of the first top panel and the second top panel and the at least one female connector affixed proximate to the respective top edges of the first bottom panel and the second bottom panel.

11. The modular garment system of claim 10, wherein the expander panel is a diamond-shaped panel.

12. The modular garment system of claim 10, wherein the expander panel is configured to be selectively attachable to the first top panel along a first upper side edge of the expander panel, the second top panel along a second upper side edge of the expander panel, the first bottom panel along the first lower side edge of the expander panel, and the second bottom panel along the lower side edge of the expander panel.

* * * * *